US005205550A

United States Patent [19]

Perino

[11] Patent Number: 5,205,550

[45] Date of Patent: Apr. 27, 1993

[54] BLOCKING DEVICE FOR A SHEET FEEDER

[75] Inventor: Andrea Perino, Cuorgnè, Italy

[73] Assignee: Olivetti-Canon Industriale S.p.A., Ivrea, Italy

[21] Appl. No.: 811,681

[22] Filed: Dec. 23, 1991

[30] Foreign Application Priority Data

Dec. 24, 1990 [IT] Italy ..... 68057 A/90

[51] Int. Cl.[5] ..... B65H 7/02

[52] U.S. Cl. ..... 271/157; 271/245

[58] Field of Search ..... 271/3.1, 157, 245

[56] References Cited

U.S. PATENT DOCUMENTS

| | | | |
|---|---|---|---|
| 4,148,473 | 4/1979 | Johnson | 271/157 X |
| 4,638,989 | 1/1987 | Senoo | 271/227 |
| 4,674,736 | 6/1987 | Tsubo | 271/245 X |
| 4,957,285 | 9/1990 | Yamada | 271/245 X |
| 5,074,545 | 12/1991 | Handa | 271/227 |
| 5,085,421 | 2/1992 | Sellers | 271/157 X |

FOREIGN PATENT DOCUMENTS

| | | |
|---|---|---|
| 3531461 | 3/1986 | Fed. Rep. of Germany . |
| 3601667 | 7/1986 | Fed. Rep. of Germany . |

OTHER PUBLICATIONS

Patent Abstract of Japan, vol. 9, No. 198 JP-A-60-06-1-445, Apr. 9, 1985.

*Primary Examiner*—Richard A. Schacher

*Attorney, Agent, or Firm*—Banner, Birch, McKie & Beckett

[57] ABSTRACT

A device for blocking or intercepting sheets for a sheet feeder may be applied to copiers, printers and similar office machines, and comprises a lever (32) capable of detecting the presence or absence of a sheet on the sheet entry hopper (16). The lever controls a stop member (42) to prevent the introduction of further sheets when at least one sheet is still present in a hopper.

2 Claims, 1 Drawing Sheet

BLOCKING DEVICE FOR A SHEET FEEDER

BACKGROUND OF THE INVENTION

The present invention relates to a device for blocking the entrance of a sheet feeder, and more particularly to a device to prevent the introduction of further sheets into the entry hopper of a feeder when at least one sheet is still present in the hopper.

A device of this type may be used in copying machines, printers and other similar office machines having automatic sheet feeders.

It is known, in conventional sheet feeders, that after the pick-up roller has advanced a sheet, the next sheet remains gripped between a roller and a double sheet rejection block. As a result of this, if other sheets are introduced, they will become trapped between the pick-up roller and the current sheet. Consequently, on the next actuation of the pick-up roller the added sheets will be advanced in a group, causing a jam in the feeder.

SUMMARY OF THE INVENTION

A preferred embodiment of the present invention provides a device for blocking the entrance to a sheet feeder. An entry hopper is provided to introduce sheets on to a supporting surface. A pick-up roller removes sheets from the supporting surface and supplies them to a machine such as a photocopier. The device comprises a feeler to determine the presence of a sheet on the supporting surface. A stop member co-operates with the supporting surface and is controlled by the feeler to prevent the introduction of sheets into the hopper when at least one sheet is present on the supporting surface.

The embodiment therefore provides a device which prevents the introduction of additional sheets into the hopper when at least one sheet is still present in the hopper.

The invention is defined in its various aspects in the appended claims to which reference should now be made.

DETAILED DESCRIPTION OF A PREFERRED EMBODIMENT

The invention will now be described in detail by way of example with reference to the drawings in which.

Figure 1:
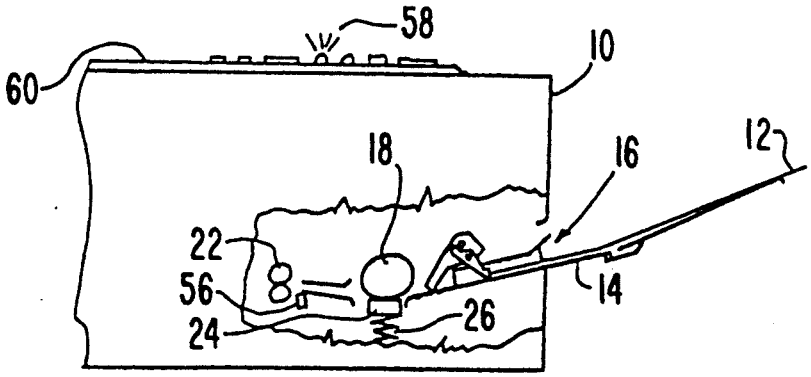
FIG. 1 represents a sheet feeder including the sheet blocking device according to the invention.

With reference to FIG. 1, sheets 12 are inserted one at a time or in groups of not more than 50 sheets on to a table 14 of an entry hopper 16, for example that of a copying machine 10. A pick-up roller 18 is selectively rotatable in the anti-clockwise direction to advance a sheet 12 towards a pair of registration and advancing rollers 22.

A block 24 is pressed against the roller 18 by a spring 24 to restrain any subsequent sheets which may remain adhering to the first, which is to be advanced by the roller 18. On the hopper 16 (FIG. 2) there is mounted a device 30 to block sheets 12' added for example on top of a sheet 12 already present on the tray 14.

Figure 3:
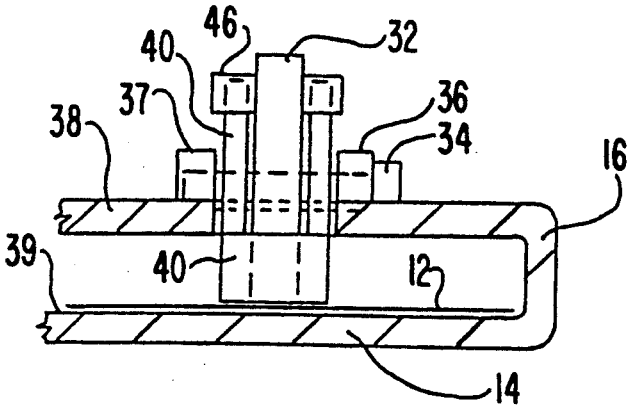
FIG. 3 is a section along the line III—III of FIG. 2.

The device 30 comprises a lever 32 which is rotatable on a pivot 34 fixed on two projections 36, 37 (FIG. 3) integral with an upper wall 38 of the hopper 16 parallel to the sheet support surface 39 of the tray 14. The lever 32 has its center of gravity G in such a position with respect to the pivot 34 that the lever 32 is made to rotate by gravity in an anti-clockwise direction.

A blocking member, or intercepting catch, 40, is hinged on the pivot 34 and has a first end 42 capable of resting on the surface 39 and a second end 44 capable of engaging with a projection 46 of the lever 32.

Figure 2:
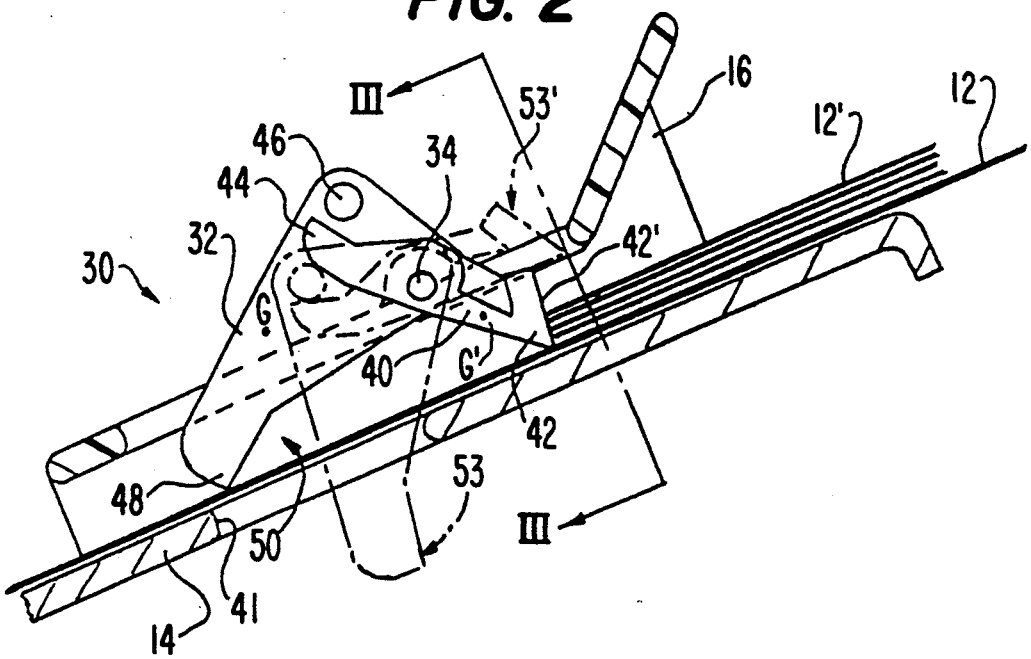
FIG. 2 represents the blocking device in FIG. 1 on an enlarged scale.

One end 48 of the lever 32 intercepts the path of the sheet 12 present in the hopper 16, whereby, when a sheet 12 is present, the lever 32 is rotated in an anti-clockwise direction and is placed in a working position 50 shown by the continuous line in FIG. 2. Consequently the blocking member or catch 40 is not engaged by the projection 46 and, having its own centre of gravity G' in such a position that it is made to rotate by gravity in an anti-clockwise direction, is placed by gravity with the end 42 resting on the sheet 12.

In this sheet interception position of the member 40, any sheets 12' added on top of sheet 12 will be intercepted and stopped by the stop face 42' of the end 42 of the catch 40.

However when sheets are not present in the hopper 16, the lever 32 may rotate in an anti-clockwise direction by gravity. The end 48 passes through the surface 39 into an aperture 41 and the lever 32 is placed in a second stable position 53, indicated by broken lines in FIG. 2.

The catch 40 is then rotated in an anti-clockwise direction by the projection 46 to a position 53' in which the end 42 is raised with respect to the surface 39.

In this position of the member 40, indicated by broken lines, it is possible to insert sheets in the hopper 16 and advance them up to the pick-up roller 18 (FIG. 1).

During the operation of the copier 10, the pick-up roller 18 advances a sheet 12 up to the rollers 22 for its registration. A sensor 56 located before the rollers 22 signals the presence of the sheet 12 to a control circuit (not shown) of the copier 10 to proceed with the copying cycle. In the next cycle, the sheets 12' halted against the end 42 prevent the anti-clockwise rotation of the catch 40 and remain blocked as shown in FIG. 2.

The sensor 56 then signals an absence of paper, as a result of which the control circuit produces an illuminated signal 58 on the panel 60 (FIG. 1) to indicate that the group of sheets 12' should be removed and reinserted in the hopper 16. As soon as the sheets 12' have been removed from the hopper 16 the catch 40 is rotated by the lever 32 to position 53', as a result of which the sheets 12' may be reinserted in the hopper 16 as far as the pick-up roller 18 (FIG. 1).

It is to be understood that modifications, additions or substitutions of parts may be made to the sheet blocking device according to the invention without departing from the scope of the invention.

For example, the catch 40 (FIGS. 2 and 3) may be replaced by a sliding block slidable perpendicularly with respect to the surface 39 and raised by the lever 32 when its end 48 enters the aperture 41 as a result of the absence of sheets on the surface 39.

I claim:

1. A device for blocking the entrance of a sheet feeder having an entry hopper to introduce sheets to a supporting surface and a pick-up roller to remove said sheets from said supporting surface, said device comprising:

a lever rotatable from an operating position in which a first end is kept raised by a sheet present on said supporting surface, to a rest position in which said first end engages an aperture when said sheet is not present; and, a stop member engageable with said lever and movable, in response to rotation of said lever, from an operating position in which said stop member engages said supporting surface thereby preventing further sheets from being inserted into said hopper, to a rest position in which said stop member is raised from said supporting surface.

2. A device for blocking the entrance of a sheet feeder, having an entry hopper to introduce sheets onto a supporting surface and a pick-up roller to remove said sheets from said supporting surface, said device comprising:

a feeler to determine the presence or absence of a sheet on said surface, said feeler comprising a lever pivoted on said hopper and having a first end capable of engaging with an aperture in said supporting surface and a second end, said lever being rotatable by gravity from an operating position in which said first end is kept raised by a sheet present on said supporting surface, to a stable position in which said first end enters said aperture when said sheet is not present, and a stop member cooperating with said supporting surface and controlled by said feeler to prevent introduction of sheets into said hopper when at least one sheet is still present on said supporting surface, said stop member comprising an oscillating catch pivoted on said second end and having an end cooperating with said supporting surface to restrain further sheets introduced into said hopper when said lever is in said operating position, said stopper member being rotated by said lever to a position in which said cooperating end is raised with respect to said supporting surface when, in the absence of sheets, said first end is engaged in said aperture.

* * * * *